US005468097A

United States Patent [19]

Bernhardt

[11] Patent Number: 5,468,097

[45] Date of Patent: Nov. 21, 1995

[54] METHOD OF CIRCULATING GROUND WATER IN GROUND REGIONS WITH A FALL OF GROUND WATER LEVEL

[75] Inventor: Bruno Bernhardt, Reutlingen, Germany

[73] Assignee: Ieg Industrie-Engineering GmbH, Reutlingen, Germany

[21] Appl. No.: 153,177

[22] Filed: Nov. 16, 1993

[30] Foreign Application Priority Data

Nov. 19, 1992 [DE] Germany ..... 42 38 969.0

[51] Int. Cl.[6] ..... E02B 11/00

[52] U.S. Cl. ..... 405/52; 405/36

[58] Field of Search ..... 405/36, 45, 50, 405/39, 52; 166/50, 52, 245; 210/747

[56] References Cited

U.S. PATENT DOCUMENTS

| | | | |
|---|---|---|---|
| 593,057 | 11/1897 | Maury | 166/52 |
| 1,342,679 | 6/1920 | Howell | 166/52 |
| 3,368,355 | 2/1968 | Shroyer . | |
| 4,254,831 | 3/1981 | Nuzman | 166/245 |
| 4,288,174 | 8/1981 | Laws . | |
| 4,755,304 | 7/1988 | Hallberg et al. | 210/747 |
| 4,820,080 | 4/1989 | Varkonyl et al. | 405/36 X |
| 5,082,053 | 1/1992 | Bernhardt . | |

*Primary Examiner*—David H. Corbin
*Attorney, Agent, or Firm*—Michael J. Striker

[57] ABSTRACT

A method of circulating ground water in a ground region with a fall of a ground water level, comprises the steps of forming a first well shaft with a water permeable shaft wall in a ground region through which ground water flows, forming at least one second well shaft with a water permeable shaft wall at a distance from the first shaft wall in a ground region with a lower ground water level than in the first well shaft, providing a transverse connection between the first well shaft and the at least one second well shaft so that the ground water can flow from the first well shaft under the action of a ground water level fall into the at least one second well shaft.

10 Claims, 2 Drawing Sheets

METHOD OF CIRCULATING GROUND WATER IN GROUND REGIONS WITH A FALL OF GROUND WATER LEVEL

BACKGROUND OF THE INVENTION

The present invention relates to a method of circulating ground water in ground regions with a fall of ground water level.

It is known to form withdrawal and absorption wells in ground regions through which ground water flows, for subsequently pumping out ground water from the withdrawal wells and then further advance the absorption wells. Thereby a drawing-in region is produced in the surrounding area of the withdrawal well, from which the ground water flows into the well. This can be recognized by lowering the ground water level into the surrounding area of the withdrawal well. On the other hand, a ground water expelling region with a raised ground water level is formed in the surrounding area of the absorption well, so that an desired circulation of the ground water through the ground region is provided. Because of this circulation, the ground water can be cleaned from contamination and/or prepared for producing drinking water.

The known methods have the advantage that, for pumping out of the ground water from the withdrawal well up to the ground surface a high energy consumption is required. Moreover, the ground water during pumping is subjected to warming up due to the density change. This leads to the problems of resupplying of the water into the absorption well. The warm water layer remains on the surface of the ground water-guiding layer, so that only a small mixing and circulation of the ground water and therefore a low efficiency during cleaning of the ground water is obtained. Moreover, the pumping out of the ground water leads to a change of the isobar and isotherm in the ground water, so that during a phase saturation for example with iron or lime always crystalline deposits and thereby clogging of wells and ground occur.

SUMMARY OF THE INVENTION

Accordingly, it is an object of the present invention to provide a method of circulating ground water in ground regions with a fall of the ground water level, which avoids the disadvantages of the prior art.

In keeping with these objects and with others which will become apparent hereinafter, one feature of the present invention resides, briefly stated, in a method of circulating ground water in accordance with which a first well shaft with a water-permeable shaft wall is formed in a ground region through which ground water flows, and then at least one second well shaft with a water-permeable shaft wall is provided at a distance from the first well shaft in a ground region with a lower ground water level, prior to providing a transverse connection between the first well shaft and the second well shaft or shafts, so that the ground water can flow from the first well shaft with use of the ground water level fall into the second well shaft or shafts.

When the method is performed in accordance with the present invention, it has the advantage that the energy of the natural ground water fall in the ground region is utilized for transportation of water from the first well which serves as a withdrawal well to the second well or wells which serves as an absorption well.

The ground water fall is almost always available, especially in spring regions and in the vicinity of rivers. The inventive method is therefore utilizable almost universally.

In accordance with another feature of the present invention, the transverse connections can be formed by pipes or hoses from a lower shaft end of the first well to the shaft or shafts of the second wells, closely underneath the ground water level. With this method the cooler water is supplied from the lower shaft end of the first well to the warmer water region of the second well or wells, which due to its greater density in the second well flows downwardly and therefore a vertical flow acts in connection with a good mixing of the ground water. The water which is again supplied into the absorption well flows no longer only on the upper surface of the ground water conduit of the absorption well, but also in deeper layers, so that as a whole a wider flow zone in the ground region and therefore a better cleaning effect is produced.

The ground water flow in the transverse connections can be supplemented and supported by a pump, in accordance with still another feature of the present invention.

In accordance with a further feature of the present invention, for obtaining a maximum size drawing-in region for the ground water circulation, at least two well shafts can be arranged in a row one after the other in direction of the withdrawing ground water layer. The successively located wells can be hydraulically connected with one another by a transverse connection.

Still another feature of the present invention is that the central well can be subdivided by a transverse wall into two shaft regions which are sealed from one another. One of the shaft regions can be used for discharging the ground water into the surrounding ground region, while another of the shaft regions can be used for withdrawing ground water from the ground region. By subdividing of the central well into two vertical regions, the above described vertical flow in the absorption well extended also to the surrounding ground region. Therefore in the surrounding area of the central well a reinforced vertical flow movement of the ground water in the ground region is produced, and the cleaning effect is additionally increased.

The distances between the wells under one another can be selected greater than the height of the water column in the well shafts, since the radius of a drawing-in region of a well is always greater than the ground water height in the well shaft. The arrangement of the wells very close to one another would unnecessarily limit the drawing-in region for the ground water circulation.

In accordance with further features of the present invention, it is possible to add into the shaft additives for water treatment, or to provide the wells at least partially with filter devices. In this way, for example a pH value regulation of the ground water or a neutralization of excessive loading with nitrates or chlorine hydrocarbons can be performed. With corresponding ground water fall heights and corresponding pressures, it is also possible to filter out radiation carriers for example plutonium, in the well shaft by corresponding filtering grains.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
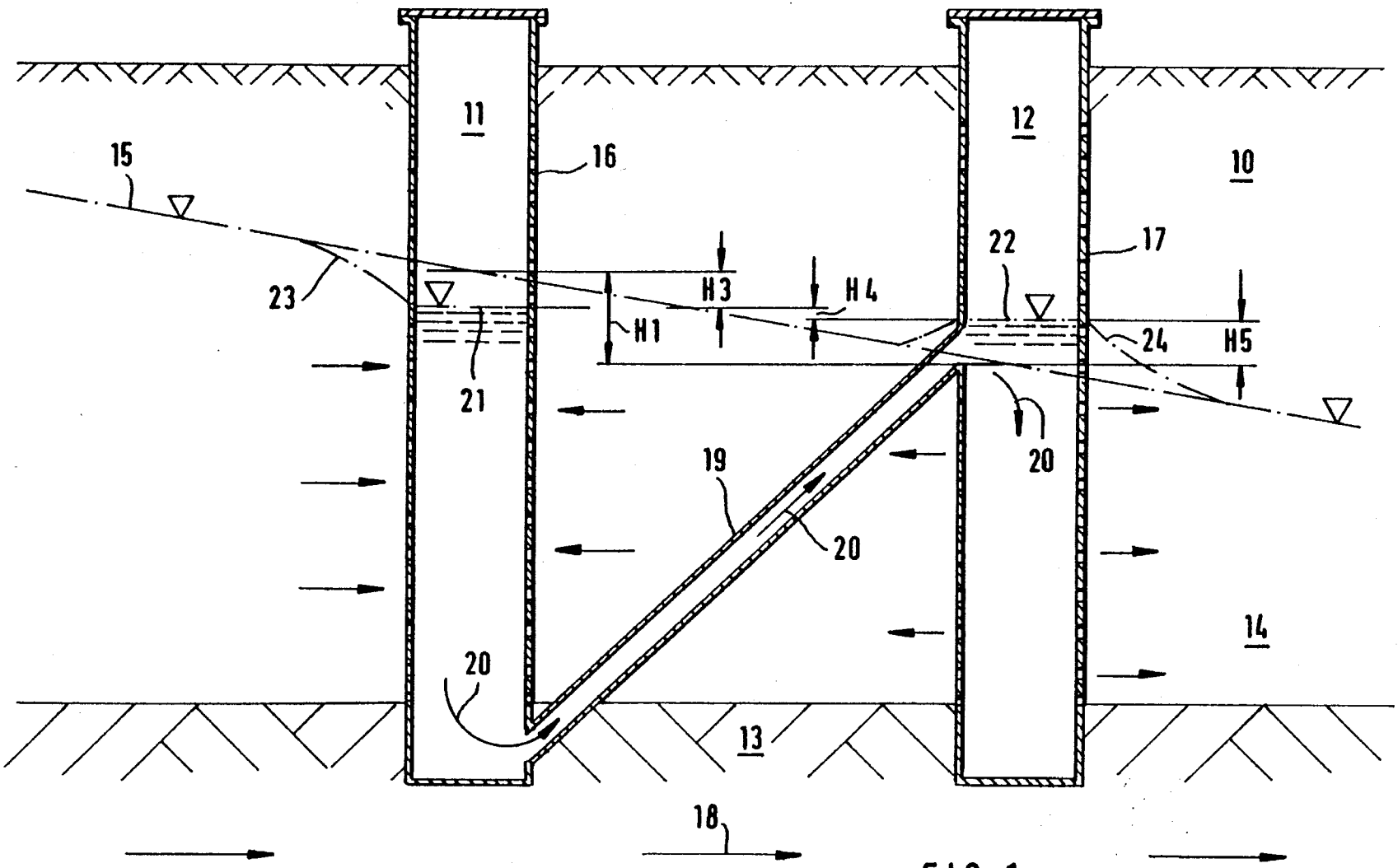
FIG. 1 is a view schematically showing a longitudinal section of two wells which are arranged one after the other in direction of a ground water fall, in accordance with the inventive method.

In accordance with a method of the present invention as shown in FIG. 1 a first well shaft 11 and a second well shaft 12 are formed in a ground region 10 through which ground water flows and extend to a bottom 13 which limits a ground layer 14 from below. The ground water level in the ground region 10 has a fall or a slope 15 which is identified with reference numeral 15 and shown in a dash-dot line. In this way the ground water levels in the first well 11 and in the second well 12 differ from one another by a value H1. Both wells or well shafts 11 and 12 have water-permeable shaft walls 16 and 17. The wells 11 and 12 are hydraulically connected with one another by a pipe 19 which extends from below upwardly in direction 18 of ground water flow.

Due to the ground water fall H1 between the wells, a water column formed in the first well 11 is higher than the water column formed in the second well 12. The resulting pressure difference provides a flow of water from the first well 11 through the pipe 19 to the second well 12 as identified in FIG. 1 with arrow 20. Due to the connection by the pipe 19, an approximate equalization of ground water levels 21 and 22 in the shafts is produced. The ground water level 21 in the first shaft 11 lowers by a value H3 while the ground water level 22 in the second well shaft 12 raises by approximately the same value H4. The difference H5 in the ground water levels 21 and 22 of the well shafts 11 and 12 which is determined after providing the transverse connection between the well shafts 11 and 12 through the pipe 19 is traced back to losses by the water resistance in the wells. After providing the hydraulic transfer connection 19 between the wells 11 and 12, water which is discharged through the pipe 19 from the well 11 is again replaced by water which flows in from the surrounding ground region 14.

A funnel-shaped lowering of the ground water level 15 is produced in the surrounding area of the well shaft 11 and identified with a dash-dot line 23. In contrast, a raise of the ground water level 15 is formed in the surrounding area of the second well shaft 12 as identified with a dash-dot line 24, and water discharges through the lateral shaft wall 17 of the well 12 into the surrounding ground region 14. The ground water at greater depths is colder and therefore through the pipe 19 relatively cold water is withdrawn at the bottom of the well shaft 11 and relatively warmer water layers are supplied into the shaft 12. Therefore, this water lowers downwardly because of its higher density in the shaft before it discharges through the openings in the shaft wall 17. In this way a good mixing of the water in the well shaft 12 and a uniform discharge into the surrounding ground region 14 occurs. In accordance with the present invention therefore ground water can discharge from one well to another well for mixing or treating without a motor drive.

Figure 2:
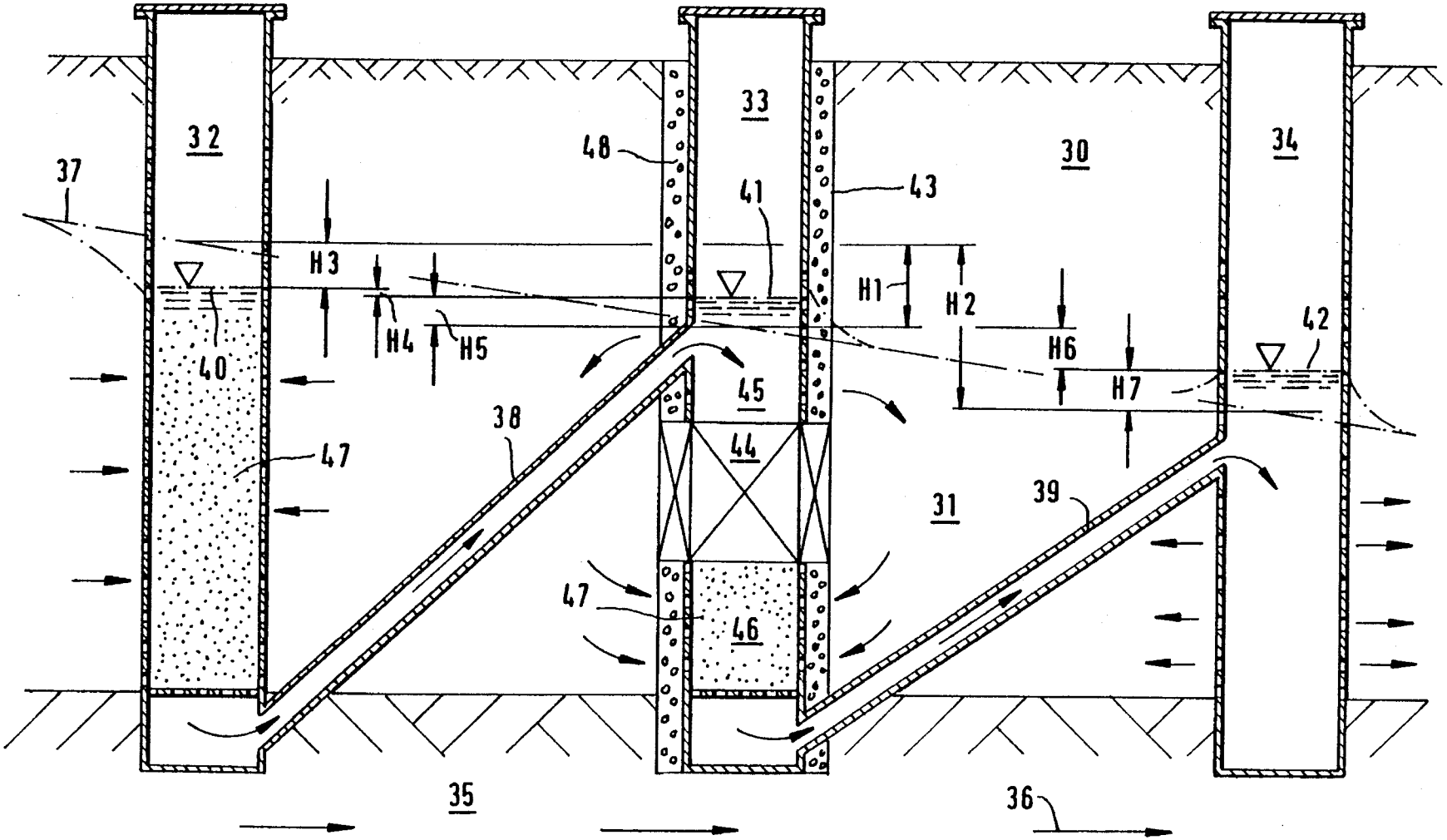
FIG. 2 is a view showing a schematical longitudinal section through three wells arranged one after the other in direction of a ground water fall in accordance with the present invention.

In accordance with another embodiment of the present invention shown in FIG. 2, a ground region 30 with a ground water conducting layer 31 has three well shafts 32, 33, 34 extending to a bottom 35 which limits the ground water conducting layer from below. The wells 32, 33, 34 are located in a row in a flow direction 36 and one after the other in direction of a falling ground water layer 37 in the ground region 30. The well shaft 32 and the well shaft 33 are hydraulically connected with one another by a pipe 38 which corresponds to the pipe 19 of FIG. 1, while the well shafts 33 and 34 are hydraulically connected with one another by a further pipe 39. The pipes 38 and 39 transport water from a lower region of a preceding well shaft closely above the ground water level of a subsequent well shaft. The ground water levels 40, 41, 42 form thereby individual well shafts 32, 33, 34 are thereby located substantially at a same level.

The wells 32 and 33 correspond to the wells 11 and 12 of FIG. 1. The well 32 operates as a withdrawal well and the well 33 operates as an absorption well. The central well 33 has only partially water permeable shaft well 43 and a seal 44 which subdivides it into two vertical shaft regions 45 and 46. The ground water supplied by the pipe 38 cannot flow therefore into the well shaft 32 downwardly, but instead is pumped outwardly into the surrounding ground region 31 and sinks downwardly due to its higher density, where it at least partially is aspirated in the lower shaft region 46 of the central shaft 33 again so that a vertical flow in the ground region 31 into the surrounding area of the well 33 is formed. The mixing and circulation of the ground water is thereby improved and the efficiency of the method is increased.

The well shaft 32 and the lower shaft region 46 of the central well 33 are provided with a filter material 47. The well 33 is moreover surrounded outwardly at the outer side of the shaft wall 43 with filter gravel. Further contaminations can be removed from the ground water through the filters.

It is to be understood that more than three wells can be arranged one behind the other, for increasing the drawing-in region for the ground water circulation. Also, a simultaneous provision of such well chains in several terrain directions with falling ground water layer is recommended.

It will be understood that each of the elements described above, or two or more together, may also find a useful application in other types of methods differing from the types described above.

While the invention has been illustrated and described as embodied in a method of circulating ground water in ground regions with a fall of a ground water level, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of circulating ground water in a ground region with a fall of a ground water level, comprising the steps of forming a first well shaft with a water permeable shaft wall in a ground region through which ground water flows; forming at least one second well shaft with a water permeable shaft wall at a distance from said first shaft wall in a ground region with a lower ground water level than in said first well shaft; providing a transverse connection between said first well shaft and said at least one second well shaft so that the ground water can flow from said first well shaft under the action of a ground water level fall into said at least one second well shaft, said providing a transverse connection including connecting said well shafts by a pipe extending from a lower shaft end of said first well shaft to said at least one second well shaft closely under a ground water level in said at least one second well shaft.

2. A method as defined in claim 1, wherein said step of providing a transverse connection includes connecting said well shafts by a hose extending from a lower shaft end of said first well shaft to said at least one second well shaft closely under a ground water level in said at least one second well shaft.

3. A method as defined in claim 1; and further comprising the step of reinforcing a ground water flow in said transverse communication by a pump.

4. A method as defined in claim 1; and further comprising the step of providing a third well shaft in the ground water region arranged in a row one after the other in direction of a falling ground water level; and providing a further transverse connection between said second and said third well shafts.

5. A method as defined in claim 1; and further comprising the step of selecting distances between said well shafts from one another so that said distances are greater than height of a water column in said well shafts.

6. A method as defined in claim 1; and further comprising the step of supplying additives into the shafts for water treatment.

7. A method as defined in claim 1; and further comprising the step of providing at least partially filtering devices in the shafts.

8. A method of circulating ground water in a ground region with a fall of a ground water level, comprising the steps of forming a first well shaft with a water permeable shaft wall in a ground region through which ground water flows; forming at least one second well shaft with a water permeable shaft wall at a distance from said first shaft wall in a ground region with a lower ground water level than in said first well shaft; providing a transverse connection between said first well shaft and said at least one second well shaft so that the ground water can flow from said first well shaft under the action of a ground water level fall into said at least one second well shaft; providing a third wall shaft in the ground water region arranged in a row one after the other in direction of a falling ground water level; providing a further transverse connection between said second and said third wall shafts; and subdividing a central one of said well shafts into two shaft regions which are sealed from one another, and operating said shaft regions so that one of said shaft regions acts for discharge of ground water from said central well shaft into a surrounding ground region while another of said well shafts acts for withdrawal of ground water from the surrounding ground region.

9. A method of circulating ground water in a ground region with a fall of a ground water level, comprising the steps of forming a first well shaft with a water permeable shaft wall in a ground region through which ground water flows; forming at least one second well shaft with a water permeable shaft wall at a distance from said first shaft wall in a ground region with a lower ground water level than in said first well shaft; providing a transverse connection between said first well shaft and said at least one second well shaft so that the ground water can flow from said first well shaft under the action of a ground water level fall into said at least one second well shaft, said providing the transverse connection including connecting said well shafts by a connecting element which is inclined in a direction opposite to a direction of fall of a ground water level.

10. A method of circulating ground water in a ground region with a fall of a ground water level, comprising the steps of forming a first well shaft with a water permeable shaft wall in a ground region through which ground water flows; forming at least one second well shaft with a water permeable shaft wall at a distance from said first shaft wall in a ground region with a lower ground water level than in said first well shaft; providing a transverse connection between said first well shaft and said at least one second well shaft so that the ground water can flow from said first well shaft under the action of a ground water level fall into said at least one second well shaft; providing a third wall shaft in the ground water region arranged in a row one after the other in direction of a falling ground water level; and providing a further transverse connection between said second and said third wall shafts, said providing a further connection between said second and third well shafts including connecting said second and third well shafts by a connecting element which is inclined in a direction opposite to the direction of a fall of the ground water level.

* * * * *